US005234332A

United States Patent [19]

Hoenke et al.

[11] Patent Number: 5,234,332

[45] Date of Patent: Aug. 10, 1993

[54] MOLDING PROCESS FOR MULTIPLE MOLDS

[75] Inventors: Mark S. Hoenke, Stow; Andrew B. Lehnert, Copley, both of Ohio; Warren L. Clark, Midland, Mich.

[73] Assignee: The Dow Chemical Company, Midland, Mich.

[21] Appl. No.: 678,389

[22] Filed: Apr. 1, 1991

[51] Int. Cl.[5] ..... B30B 7/02

[52] U.S. Cl. ..... 425/338; 100/199; 100/208; 100/219; 100/264; 425/125; 425/129.1; 425/339; 425/340; 425/406; 425/450.1; 425/451.9

[58] Field of Search ..... 100/199, 208, 221, 264, 100/119; 425/234, 338, 339, 340, 394, 395, 406, 408, 450.1, 451.2, 451.3, 451.9, 454, 589, 590, 595, 112, 117, 125, 126.1, 129.1

[56] References Cited

U.S. PATENT DOCUMENTS

| | | | |
|---|---|---|---|
| 2,288,356 | 6/1942 | Humphrey | 100/199 |
| 2,830,323 | 4/1958 | Krebs, Jr. et al. | 425/544 |
| 3,009,495 | 11/1961 | Coate | 100/199 |
| 3,158,903 | 12/1964 | Fischer et al. | 425/186 |
| 3,370,526 | 2/1968 | Parker | 100/208 |
| 3,473,196 | 10/1969 | Hull et al. | 425/160 |
| 3,635,074 | 1/1972 | Moos et al. | 100/258 A |
| 3,638,559 | 2/1972 | Parker | 100/199 |
| 3,787,165 | 1/1974 | Fischer et al. | 425/450.1 |
| 3,941,548 | 3/1976 | Bruder | 425/450.1 |
| 4,059,381 | 11/1977 | Schott, Jr. | 425/406 |
| 4,383,814 | 5/1983 | Rocatti et al. | 425/338 |
| 4,408,981 | 10/1983 | Brown | 425/589 |
| 4,504,208 | 3/1985 | Kurumiji et al. | 425/589 |
| 4,608,922 | 9/1986 | Pöhl | 100/264 |
| 4,702,688 | 10/1987 | Schenk | 425/450.1 |
| 4,718,845 | 1/1988 | Sheffield et al. | 425/589 |

FOREIGN PATENT DOCUMENTS

| | | | |
|---|---|---|---|
| 0421799A2 | 4/1991 | European Pat. Off. . | |
| 10489 | 6/1956 | Fed. Rep. of Germany | 100/199 |
| 1082728 | 11/1960 | Fed. Rep. of Germany | 100/199 |
| 56-1298 | 1/1981 | Japan . | |
| WO 88/03448 | 5/1988 | PCT Int'l Appl. . | |

*Primary Examiner*—Jay H. Woo
*Assistant Examiner*—James P. Mackey

[57] ABSTRACT

Molding press apparatus (20) for simultaneously operating a plurality of molds (M) having multiple mold parts (M1, M2) including, a framework (25), first and second platen assemblies (U,L) supported by the framework for carrying the mold parts of the molds, a third platen assembly (I) interposed between the first and second platen assemblies for mounting mating mold parts in opposed relation to the mold parts carried by the first and second platen assemblies, a drive assembly (80) for simultaneously moving the first and second platen assemblies relative to the third platen assembly for opening and closing the molds. Loading and unloading apparatus (150) may be provided for simultaneously transporting preformed fiber reinforcements (R) to the molds and for transporting molded parts (P) away from the molds associated with the platen assemblies.

19 Claims, 11 Drawing Sheets

162
161
166
150
P
163
164
160
156
165
187
186
185
155
S1
170
182
171
183
179
I
181
180
177
178
P
163
164
162
176
160
175
161
S3
166
165
194
193
155
192
156
191
170
195
196
171
197
L
190
200
198
199
203
201
202

MOLDING PROCESS FOR MULTIPLE MOLDS

TECHNICAL FIELD

The present invention relates to presses for molding fiber reinforced parts using reactive liquid resins. More particularly, the present invention relates to high output presses for molding fiber reinforced parts from various plastic resins such as polyester, epoxy, and polyurethane. More specifically, the present invention relates to a multiple cavity press for simultaneously molding a plurality of fiber reinforced parts from such resins.

BACKGROUND ART

Reinforced plastic parts or products are composite structures in which a resin, either thermosetting or thermoplastic, is combined with a reinforcing member to strengthen and improve various properties of the plastic matrix. Particularly useful processes include resin transfer molding (RTM) and structural reaction injection molding (S-RIM). The former usually employ epoxies or polyester resins, although other thermosetting resins can also be employed. Polyurethanes are employed in S-RIM systems.

Both processes commonly employ a fiber preform or mold charge blank which may approximate the shape of the composite products or at least provides a structural backbone for the product. The mold charge blank is placed inside of a multiple-piece mold, after which the liquid resin or reaction components are transferred into the closed mold to impregnate the reinforcement material and fill all void space within the mold. After the necessary reaction and cure time for the particular resin, the mold is opened, and the finished composite product is removed.

Such composite products are currently of particular interest and importance in a variety of industrial applications, such as the automotive industry, where features such as weight reduction, strength, appearance, durability, flexibility, and consolidation of parts are significant design considerations. Automobile bumpers, for instance, made of polyurethanes reinforced with fibers from a mold charge blank, provide improved performance characteristics, particularly strength, and may also reduce the total weight and number of parts required.

Fiber mold charge blanks are manufactured separately and are supplied to the mold for combination with the liquid resin component(s). A variety of methods have been employed for making mold charge blanks, including the spraying of chopped fibers onto a molded surface and the forming of reinforcing mat or fabric in desired thickness and layers into the shape of the mold charge blank. The fiber material is normally combined with a thermoplastic binder material, and the "laid up" material is then placed in a preheat oven, transferred to a mold, pressed by the mold to the desired shape, and cooled to produce the actual mold charge blank which can be handled and stored until final manufacture. The binder material stiffens the mold charge blank, giving it appropriate structural integrity for liquid molding in the forming tool or handlability for storage or transfer to the final mold where resin transfer occurs.

Advances in automating the production of mold charge blanks have made the final molding process a primary limiting factor in the productivity of relatively large products requiring molds having dimensions on the order of four feet by eight feet. The final molding process is severely limited in a time sense due primarily to the reaction and cure time of the resins, which may be on the order of two or three minutes for S-RIM and up to fifteen minutes for epoxy RTM. Further, due to the size, weight, and complexity of the molds, most presses for such relatively large products employ very large and relatively expensive hydraulic systems.

In the case of relatively small products made of such resins, it is known in the art to employ turret-type molding presses wherein a turntable moves lower mold sections into operative relationship with a fixed lower platen and a vertically movable upper platen. Various vertical and horizontal press arrangements are also known wherein cylinders effect mold closing, and the same or other cylinders apply the requisite clamping pressure. In applications involving larger products, tie rod-type elements or other refinements have been employed to meet clamping force requirements while remaining within reasonable press size specifications. Multi-opening presses, including what are termed double-opening presses, have been employed in the form of side by side openings for products in the nature of sheet materials having very limited thickness. It is also known to provide what are termed stack molds in horizontal thermoplastic injection molding presses which may be operated by rack and pinion drive mechanisms. Due to size, weight, and cost considerations, these known press configurations have not been applicable to designs employing multiple molds for large products or parts of the type herein contemplated. Accordingly, presses for such large products have typically been single mold presses which are limited as noted above in production capacity.

DISCLOSURE OF THE INVENTION

Therefore, an object of the present invention is to provide a press for molding fiber reinforced parts of reactive liquid resins which achieves greatly improved productivity in terms of the number of parts produced over a given time interval. Another object of the present invention is to provide such a press which has a plurality of molds in which a plurality of parts may be simultaneously molded, thereby reducing the capital investment and floor space requirements in comparison with use of a plurality of presses where each mount a single mold. A further object of the invention is to provide such a press arranged such that a single pumping and metering system for the reactive liquid resins may service all of the molds, thereby reducing the number of such systems normally required.

Another object of the present invention is to provide a press for molding fiber reinforced parts of reactive liquid resins which is of the vertical type and which has upper and lower moving platens that are counterbalanced, whereby the driving force necessary to operate the press is greatly reduced. Still another object of the present invention is to provide such a press wherein the counterbalanced platens do not require elaborate, heavy-duty safety locking devices to preclude uncontrolled movement of the platens in the event of a failure in the press drive system. A further object of the present invention is to provide such a press which eliminates the need for the large, high pressure, high powered hydraulic systems normally employed with the inherent high sound pressure levels and propensity for hydraulic fluid leaks with attendant contamination problems and maintenance requirements.

A further object of the present invention is to provide a press for molding fiber reinforced parts of reactive liquid resins which may be readily powered by an electro-mechanical drive system. Yet another object of the invention is to provide such an electro-mechanical press which has recognized reliability, reduced maintenance, and cost savings in comparison with hydraulic systems for comparable sized presses. A still further object of the present invention is to provide such a press wherein the electro-mechanical drive system interfaces with chains interconnecting the moving platens as a portion of the counterbalance system therefor. Another object of the present invention is to provide such a press wherein the drive system for the chains serves to preload the molds between a stationary intermediate platen and a movable lower platen, while insuring gravity seating of the molds between the stationary intermediate platen and the movable upper platen.

Another object of the present invention is to provide a press for molding fiber reinforced parts of reactive liquid resins wherein a stationary intermediate platen is interposed between upper and lower moving platens to double the number of molds operatively manipulated by the press. A further object of the present invention is to provide such a press wherein the intermediate platen may mount a plurality of mold sections for a plurality of molds on both the upper and lower sides thereof for operative engagement with mating mold sections on upper and lower moving platens. A still further object of the present invention is to provide such a press which can be manufactured in a variety of sizes to accommodate mold sizes and free opening dimensions for a wide variety of parts manufactured from such reactive liquid resins.

A further object of the present invention is to provide a press for molding fiber reinforced parts of reactive liquid resins wherein tonnage or mold clamping force is applied by the tie rod tension screws. Another object of the present invention is to provide such a press wherein the tie rod tension screws operate in conjunction with bushings to effect guiding of the platens during opening and closing of the upper and lower mold sections, thereby reducing the relative overall mass and thus the cost of the press in comparison with presses having separate clamping and guiding elements. A still further object of the present invention is to provide such a press wherein the tie rods are individually rotated to the proper torque to establish the necessary amount and distribution of mold clamping force and individually adjustable to take into account gradual wear of the operative parts.

Still another object of the present invention is to provide a press for molding fiber reinforced parts of reactive liquid resins which has a plurality of robotic shuttles, one servicing each of the mold mounting spaces, for delivering preformed fiber reinforcements to the mold cavities and for simultaneously removing completed molded parts therefrom. Yet another object of the present invention is to provide such a press wherein the robotic shuttles are driven by a plurality of quills activated by a common drive system for simultaneously unloading and loading all of the molds.

At least one or more of the foregoing objects, together with the advantages thereof over known press apparatus for the molding of fiber reinforced parts of reactive liquid resins, which will become apparent from the specification which follows, are accomplished by the present invention.

In general, the present invention contemplates molding press apparatus for simultaneously operating a plurality of molds having multiple mold parts, including a framework, first and second platen assemblies supported by the framework for carrying mold parts of the molds, a third platen assembly interposed between the first and second platen assemblies for mounting mating mold parts in opposed relation to the mold parts carried by the first and second platen assemblies, platen suspension assemblies for counterbalancing the first platen assembly in relation to the second platen assembly, and a platen assembly for simultaneously moving the first and second platen assemblies relative to the third platen assembly for opening and closing the molds.

The present invention further contemplates apparatus for loading preforms into and removing molded parts from a molding press carrying a plurality of molds, including shuttle assemblies for moving into and out of position for selectively engaging and releasing the preforms and the molded parts, drive quills extending through the platen assemblies and operatively interengaging the shuttle assemblies, and a quill drive assembly for effecting selective rotation of drive quills to move the shuttle assemblies relative to the molds for loading preforms and removing molded parts.

PREFERRED EMBODIMENT FOR CARRYING OUT THE INVENTION

Figure 1:
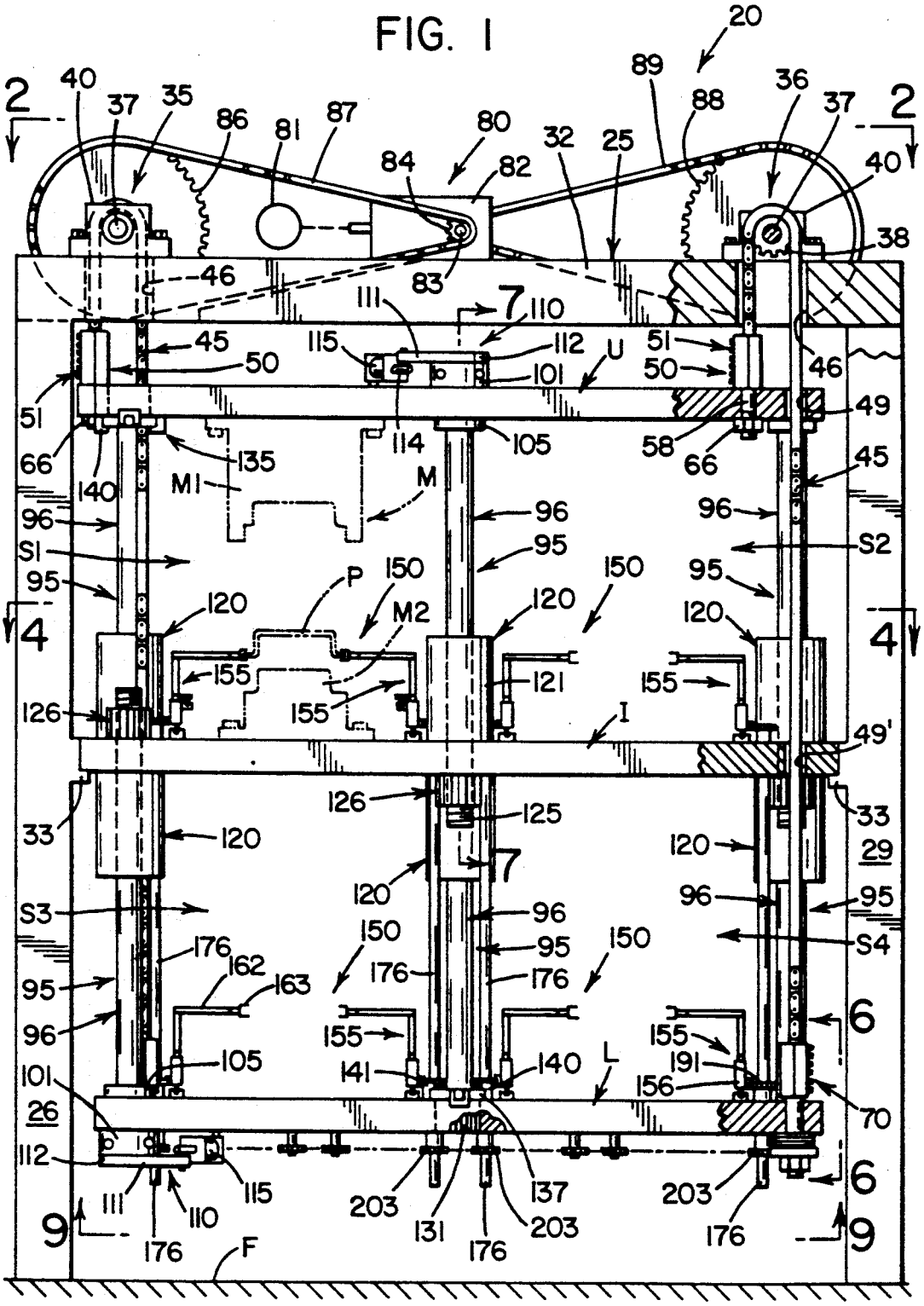
FIG. 1 is a front elevational view of an exemplary molding press embodying the concepts of the present invention showing the interrelation between the platens in the open position of the press.
Figure 3:
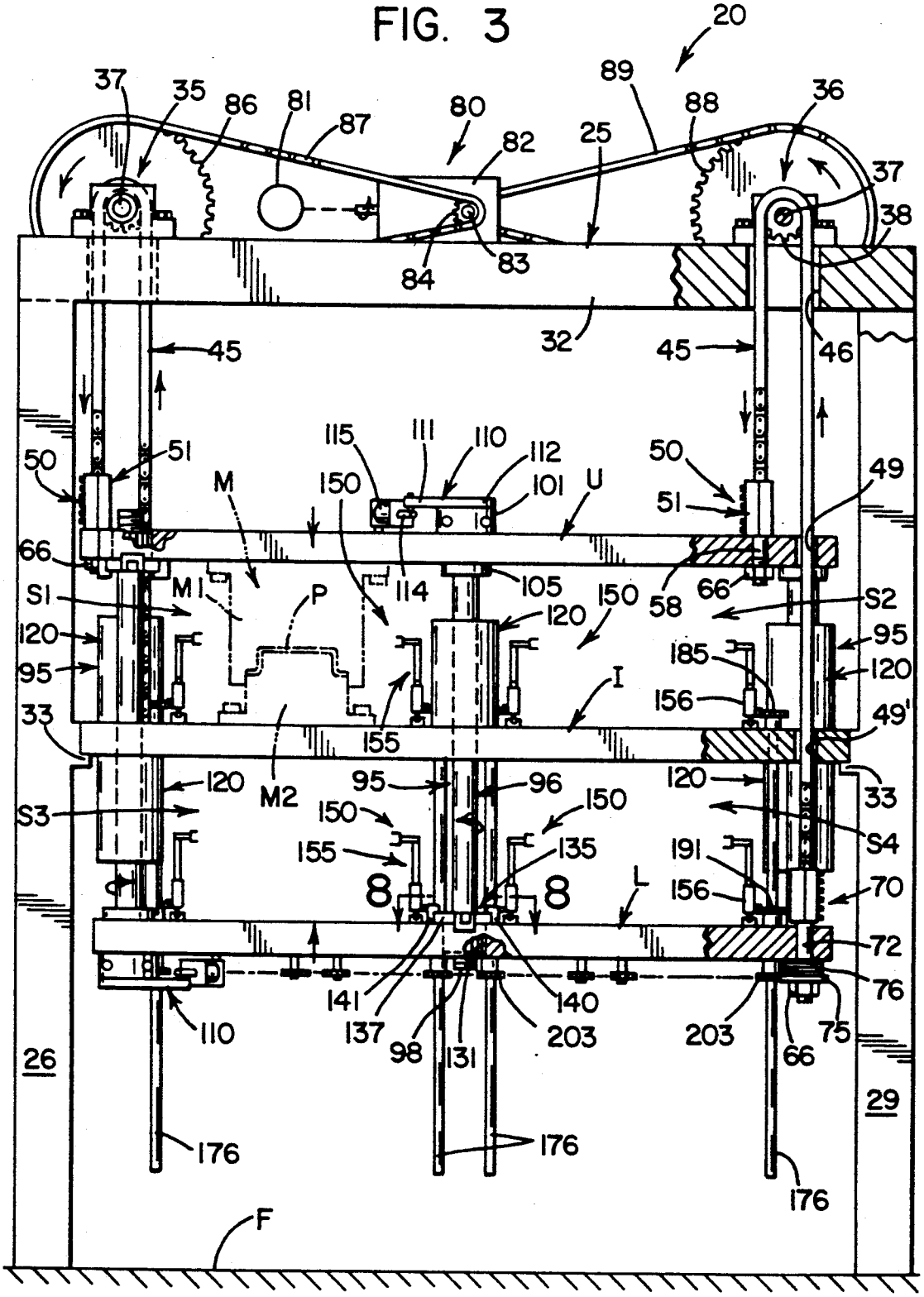
FIG. 3 is a fragmentary front elevational view of the molding press similar to FIG. 1 showing the interrelation between the platens in the closed position of the press.

A press for molding fiber reinforced parts of reactive liquid resins according to the concepts of the present invention is generally indicated by the numeral 20 in the drawings figures. As best seen in FIGS. 1 and 3 of the drawings, the press 20 is in a form commonly referred to as a vertical press configuration in that the platens are vertically displaced relative to each other. As will be detailed hereinafter, the platens are controllably vertically moved in effecting the requisite opening and closing movements of the press 20.

As shown, the press 20 has an upper movable platen assembly, generally indicated by the reference letter U, a lower movable platen assembly, generally indicated by the reference letter L, and a stationary intermediate platen assembly, generally indicated by the reference letter I. As will be appreciated from the following description, the upper movable platen assembly U and the lower movable platen assembly L are preferably mounted for simultaneous movement relative to each other and in the preferred form shown in the drawings relative to the stationary intermediate platen assembly I.

The platens U, L, and I are conventionally configured to mount a plurality of molds of the type commonly employed in the molding of reactive liquid resins of the type hereinabove described. As best seen in FIGS. 1 and 3, the press 20 has a pair of mold mounting spaces, generally indicated by the designations S1 and S2, formed between the upper movable platen assembly U and the stationary intermediate platen assembly I. A second pair of mold mounting spaces, generally indicated by the designations S3 and S4, are located between the stationary intermediate platen assembly I and the lower movable platen assembly L. For exemplary purposes, a conventional mold, generally indicated by the letter M, is depicted in mold mounting space S1, it being appreciated that similar molds would be mounted in mold spaces S2, S3, and S4. As shown, the mold M consists of an upper female mold section M1, which is detachably attached to the underside of upper movable platen assembly U, and a lower male mold section M2, which is similarly detachably attached to the upper surface of the stationary intermediate platen assembly I. The construction, positioning, and operation of suitable molds for molding reactive liquid resins is well known to persons skilled in the art. It will be noted that the position of platens U and L and the mold parts or sections M1, M2 of the mold M are shown in the press open position in FIG. 1 and in the press closed position in FIG. 3 of the drawings.

For purposes of supporting the platens U, I, and L and for mounting other operative components, the press 20 has a framework, generally indicated by the numeral 25. The framework 25 has a plurality of vertical members which extend from a supporting foundation F upwardly a substantial distance. As shown particularly in FIGS. 1 and 4, there are front, middle, and rear posts 26, 27, and 28, respectively, on the left side of the press 20, as viewed in FIG. 1 of the drawings, and front, middle, and rear posts 29, 30, and 31, respectively, on the right side of the press 20, as viewed in FIG. 1. The vertical posts 26-31, inclusive, are intertied at their vertically upper extremities by a top plate 32 to constitute framework 25 as a substantially rigid structural member.

The posts 26-31, inclusive, have inwardly projecting ledges 33, preferably substantially intermediate the length thereof, for purposes of supporting the stationary intermediate platen assembly I thereon, as best seen in FIGS. 1 and 3. The stationary intermediate platen assembly I may be permanently affixed in place as by welds (not shown) or other fastening elements. The attachment of stationary intermediate platen assembly I to the projecting ledges 33 is material in imparting additional rigidity to the framework 25.

Figure 2:
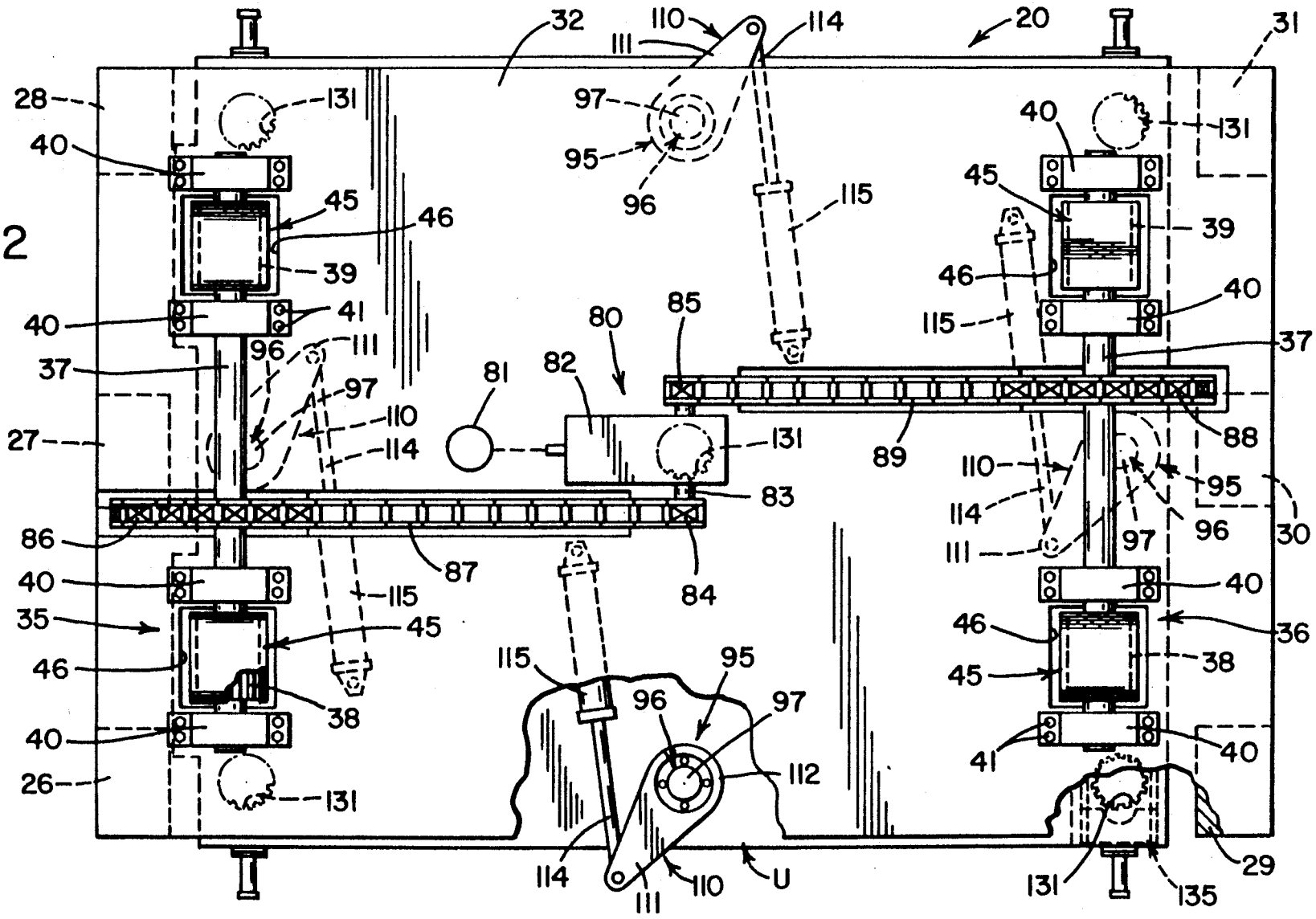
FIG. 2 is a top plan view of the molding press of FIG. 1 showing particularly details of the platen drive mechanism.

The upper moving platen assembly U and lower moving platen assembly L are supported relative to framework 25 by platen suspension assemblies, generally indicated by the numerals 35 and 36. The platen suspension assemblies 35 and 36 are positioned to the left and right sides of the press 20, respectively, as depicted in FIGS. 1-3. Each platen suspension assembly 35, 36 includes as a primary component thereof a shaft 37 which preferably extends a substantial portion of the front to rear dimension of the press 20. Each of the shafts 37 mount, preferably spaced a substantial distance along and near the axial extremities thereof, sprockets 38 and 39, respectively (see FIG. 2). The shafts 37 of platen suspension assemblies 35 and 36 are positioned and supported on the top plate 32 of framework 25 by a plurality of bearings 40 attached to top plate 32 as by suitable fasteners 41. Bearings 40 are preferably located on the shafts 37 to either side of and proximate to each of the sprockets 38, 39. The sprockets 38, 39 are non-rotatably attached to the shafts 37 for selective rotation therewith, as is hereinafter described.

Each shaft 37 of platen suspension assemblies 35, 36 supports a connector such as a length of lift chain 45. Each of the lift chains 45 are reeved about the sprockets 38, 39 and extend downwardly of shafts 37 through apertures 46 located in the top plate 32. One extremity of each of the lift chains 45 is attached to the upper movable platen assembly U. The other extremity of each of the lift chains 45 extends through apertures 49 in the upper movable platen assembly U and apertures 49' in intermediate platen assembly I and are attached to the lower movable platen assembly L. As shown, each of the four lift chains 45 are of substantially identical length.

Figure 5:
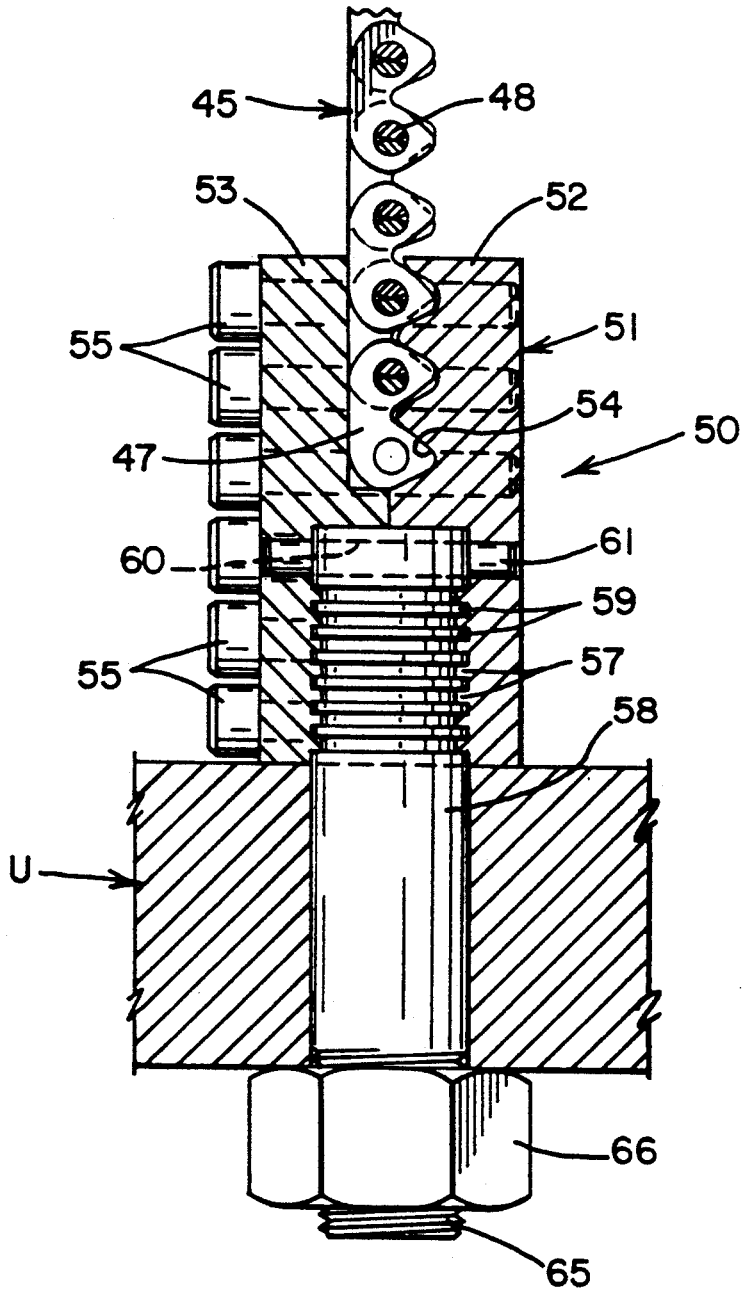
FIG. 5 is an enlarged fragmentary sectional view showing the attachment of the lift chain of the platen drive mechanism to the upper moving platen assembly.

As seen in FIGS. 1 and 3, the extremity of lift chains 45 terminating proximate the upper movable platen assembly U are engaged by a platen attachment assembly, generally indicated by the numeral 50. Each of the four platen attachment assemblies 50 include a clamp connector 51 which is affixed to the extremity of each lift chain 45. Details of the clamp connectors 51 are best seen in FIG. 5 of the drawings. The clamp connectors 51 consist of a pair of blocks 52 and 53. The blocks 52 have inverse tooth profiles 54 proximate the upper extremities thereof which are adapted to matingly engage a plurality of links 47 of lift chain 45. The lift chain 45 has the links 47 joined by pins 48 in conventional fashion. As shown, the blocks 52 have inverse tooth profiles 54 adapted to receive two links 47 and a portion of a third link 47 constituting one extremity of a lift chain 45. The clamp connector 51 is connected to lift chain 45 by positioning the blocks 52, 53, as depicted in FIG. 5, and by joining blocks 52 and 53 by a plurality of fasteners, such as the cap screws 55.

The clamp connectors 51, as seen in FIG. 5, have bores with spaced rings 57 proximate their lower extremities to receive through shafts 58 having axially spaced rings 59 which matingly engage the rings 57 of the blocks 52, 53. With the clamp connector 51 in place, as depicted in FIG. 5, the lift chain 45 and through shafts 58 are joined in fixed axial relationship. The blocks 52, 53 of clamp connector 51 and through shafts 58 may be provided with a bore 60 which seats a retaining pin 61 to preclude relative rotation between the through shafts 58 and the clamp connector 51.

As best seen in the upper right hand portion of FIGS. 1 and 3, the through shafts 58 of the upper platen attachment assemblies 50 each extend through the upper movable platen assembly U and have threads 65 at the lower extremity thereof to receive a retaining nut 66. It will thus be appreciated that the upper movable platen assembly U is supported at four spaced locations by the lift chains 45 by virtue of the upper platen attachment assemblies 50.

As seen in FIGS. 1 and 3, the extremity of lift chains 45 terminating proximate the lower movable platen assembly L are engaged by a platen attachment assembly, generally indicated by the numeral 70. The four platen attachment assemblies 70 are similar in some respects and different in other respects from platen attachment assemblies 50. Each of the four platen attachment assemblies 70 have identical clamp connectors 71, as best seen in detail in FIG. 6 of the drawings. The clamp connectors 71 consist of a pair of blocks 52 and 53. The blocks 52 and 53 have internal contours 54 proximate the upper extremities thereof which are adapted to matingly engage a plurality of links 47 of a lift chain 45. The blocks 52 have inverse tooth profiles 54 adapted to receive two links 47 and a portion of a third link 47 constituting an extremity of a lift chain 45. The clamp connector 71 is connected to lift chain 45 by positioning the blocks 52, 53, as depicted in FIG. 6, and by joining blocks 52 and 53 by a plurality of fasteners, such as the cap screws 55.

Figure 6:
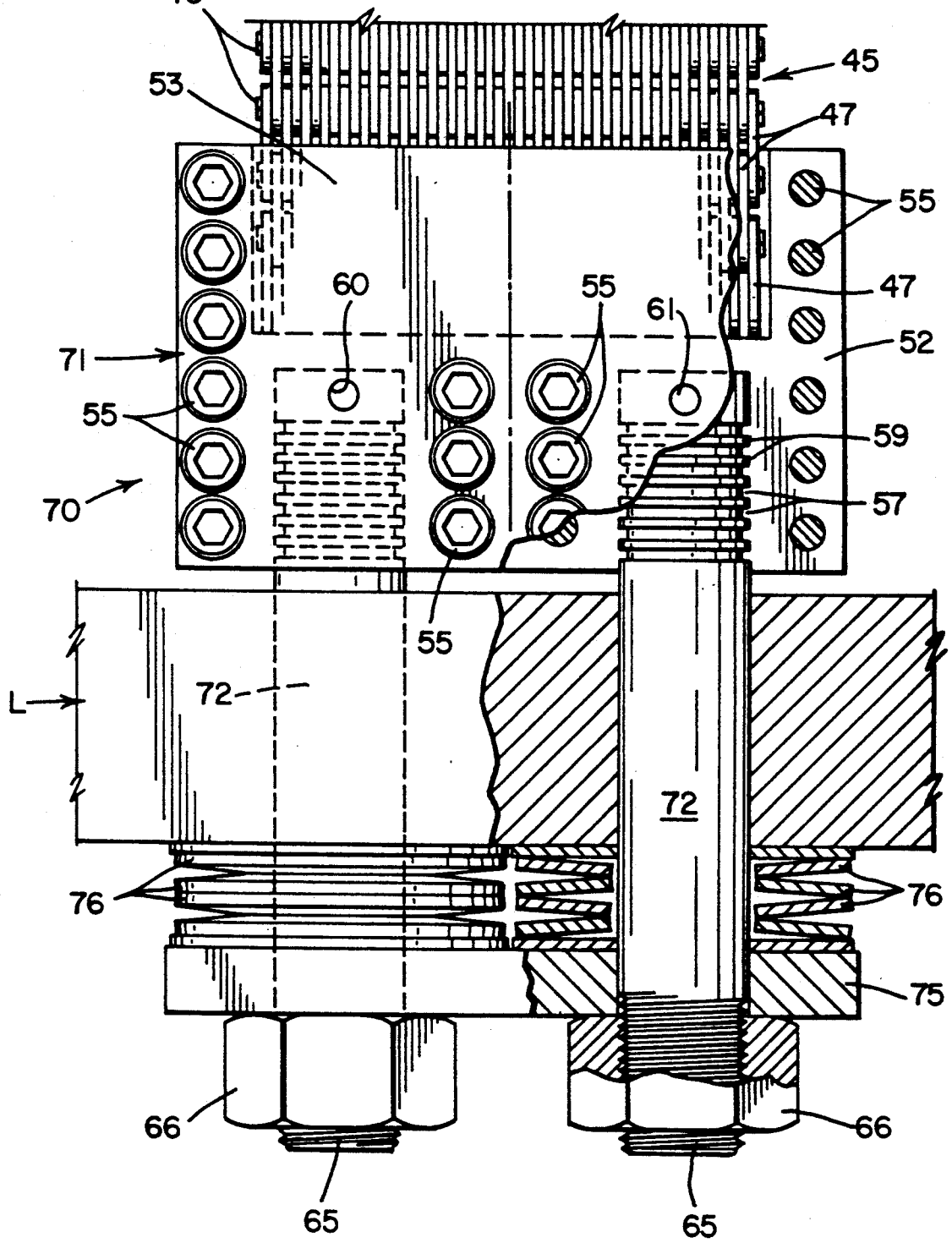
FIG. 6 is an enlarged side elevational view with portions broken away and portions shown in section, as viewed substantially along the line 6—6 of FIG. 1, showing details of the attachment of the lift chain of the platen drive mechanism to the lower moving platen assembly.

The clamp connectors 71, as seen in FIG. 6, have bores with spaced rings 57 proximate their lower extremities to receive through shafts 72 having rings 59 which matingly engage the rings 57 of the blocks 52, 53. With the clamp connector 71 in place, as depicted in FIG. 6, the lift chain 45 and through shafts 72 are joined in fixed axial relationship. The blocks 52, 53 of clamp connector 71 and through shafts 72 may be provided with a bore 60 which seats a retaining pin 61 to preclude relative rotation between the through shafts 72 and the clamp connector 71.

The platen attachment assemblies 70 differ from the platen attachment assemblies 50 in certain details which are depicted in FIG. 6 of the drawings. In particular, the through shafts 72 which extend through the lower movable platen assembly L are of a substantially greater axial length than through shafts 58. More specifically, the through shafts 72 are of such an axial length as to extend through a loading plate 75, which is spaced a distance from and generally parallels the lower movable platen assembly L. The through shafts 72 extend a distance beyond loading plate 75 and terminate in threads 65 which receive retaining nuts 66. Interposed between the underside of lower movable platen assembly L and the loading plate 75 and carried on through shafts 72 are a plurality of disk springs 76. While four disk springs 76 disposed in series are depicted in FIG. 6 of the drawings, it will be appreciated that more or less such springs 76 suitably disposed may be employed, depending upon weight, loading, and displacement requirements for a particular installation. It will be understood that the suspension of the lower movable platen assembly L by the platen attachment assemblies 70 will permit seating and progressive preloading of molds M carried between the lower movable platen assembly L and the stationary intermediate platen assembly I during press closure in a manner detailed hereinafter.

Thus, the upper movable platen assembly U and the lower movable platen assembly L are counterbalanced by the lift chains 45 about the shafts 37 of platen suspension assemblies 35, 36. Since the upper movable platen assembly U and the lower movable platen assembly L may be of comparable weight, there is little tendency for relative motion between the platens L, U except as may be initiated by rotation of the shafts 37 carrying the sprockets 38, 39 which support the lift chains 45. However, in all instances except for incremental movements during preloading as will be hereinafter described, vertical upward or downward displacement of either of the platens U, L will be accompanied by a commensurate displacement of the other of the platens U, L in the opposite vertical direction.

The opening and closing motion of the upper movable platen assembly U and the lower movable platen assembly L of the press 20 are instituted and powered by a platen drive assembly, generally indicated by the numeral 80. The platen drive assembly 80 is best seen in FIGS. 1-3, inclusive, of the drawings. The platen drive assembly 80 is powered by a suitable variable-speed, reversible power source, which in the preferred embodiment is a reversible DC motor 81, with an appropriate brake. The motor 81 is coupled in conventional fashion to a speed reducer 82. The motor 81 and speed reducer 82 may conveniently be mounted on the top plate 32 of the framework 25. The speed reducer 82 has an output shaft 83 to which are attached a pair of sprockets 84 and 85 (see FIG. 2). The speed reducer 82 may advantageously be positioned substantially midway between the shafts 37, 37 of the platen suspension assemblies 35 and 36.

The shaft 37 of platen suspension assembly 35 mounts a sprocket 86 which is non-rotatably affixed thereto and aligned with the sprocket 84 on output shaft 83 of speed reducer 82. The sprockets 84 and 86 are joined by a drive chain 87 such that rotation of output shaft 83 of speed reducer 82 is transmitted to the shaft 37 of platen suspension assembly 35. Similarly, the shaft 37 of platen suspension assembly 36 mounts a sprocket 88 which is non-rotatably affixed thereto and aligned with the sprocket 85 on output shaft 83 of speed reducer 82. The sprockets 85 and 88 are joined by a drive chain 89 such that rotation of output shaft 83 of speed reducer 82 is transmitted to the shaft 37 of platen suspension assembly 36. Since both of the shafts 37 of platen suspension assemblies 35, 36 are powered by output shaft 83 of speed reducer 82, and sprockets 84 and 85 are of equal diameter as are sprockets 86 and 88, any extent of rotational travel of output shaft 83 is transmitted to each of the shafts 37 and results in an equiangular rotation thereof proportional to the angular rotation of shaft 83.

It will thus be appreciated that actuation of the motor 81 is transferred to the platen suspension assemblies 35, 36 to effect the closing of the platens U, L from the press open position of FIG. 1 to the press closed position of FIG. 3. Operation of the motor 81 in a reverse direction effects movement from the press closed position of FIG. 3 to the press open position of FIG. 1.

The aforedescribed platen suspension assemblies 35, 36 permit a preloading of the molds M located between the lower movable platen assembly L and stationary intermediate platen assembly I once the press 20 reaches the closed position depicted in FIG. 3 of the drawings. It will be appreciated that such preloading is significant because gravity operating on the lower movable platen assembly L opposes closing of molds M positioned thereon. In this respect, continued drive by operation of motor 81 upon reaching press closure tends to compress the disk springs 76 and thus progressively forcibly seat and pre-load the molds M between the lower movable platen assembly L and the intermediate platen assembly I. This continued drive of the platen drive assembly 80 during pre-loading creates an extent of slack in the portion of the lift chains 45 between the sprockets 38, 39 and the platen attachment assemblies 50 due to the compression of the disk springs 76 when coupled with the fact that the upper movable platen assembly U is already in the closed position of the molds M between the upper movable platen assembly U and the stationary intermediate platen assembly I. With the lift chains 45 thus provided with an extent of slack, gravity forces operative on the upper movable platen assembly U and mold sections M1 attached thereto effect complete closure and preloading of the molds M interposed between the upper movable platen assembly U and stationary intermediate platen assembly I.

The guiding of the upper movable platen assembly U and the lower movable platen assembly L during opening and closing of the press 20 and the application of tonnage or mold clamping force necessary for molding parts of the reactive liquid resins is effected by a plurality of platen guide and clamping assemblies, generally indicated by the numeral 95, as seen in FIGS. 1-3 of the drawings. For the depicted press 20, there are nine platen guide and clamping assemblies 95, as best seen in FIG. 2. As seen in FIGS. 1 and 2, there are three platen guide and clamping assemblies 95 located proximate the front, rear, and medial portions of the press 20 to the left of the mold mounting spaces S1 and S3; three platen guide and clamping assemblies 95 at the front, rear and middle portions laterally intermediate the mold mounting spaces S1, S3 and the mold mounting spaces S2, S4; and three platen guide and clamping assemblies 95 at the front, rear, and intermediate portions to the right of the mold mounting spaces S2 and S4. With this arrangement, four spaced platen guide and clamping assemblies 95 effect spaced and balanced guiding of the upper movable platen assembly U or lower movable platen assembly L, and five platen guide and clamping assemblies 95 effect spaced and balanced guiding of the other of the upper movable platen assembly U or lower movable platen assembly L.

Figure 7:
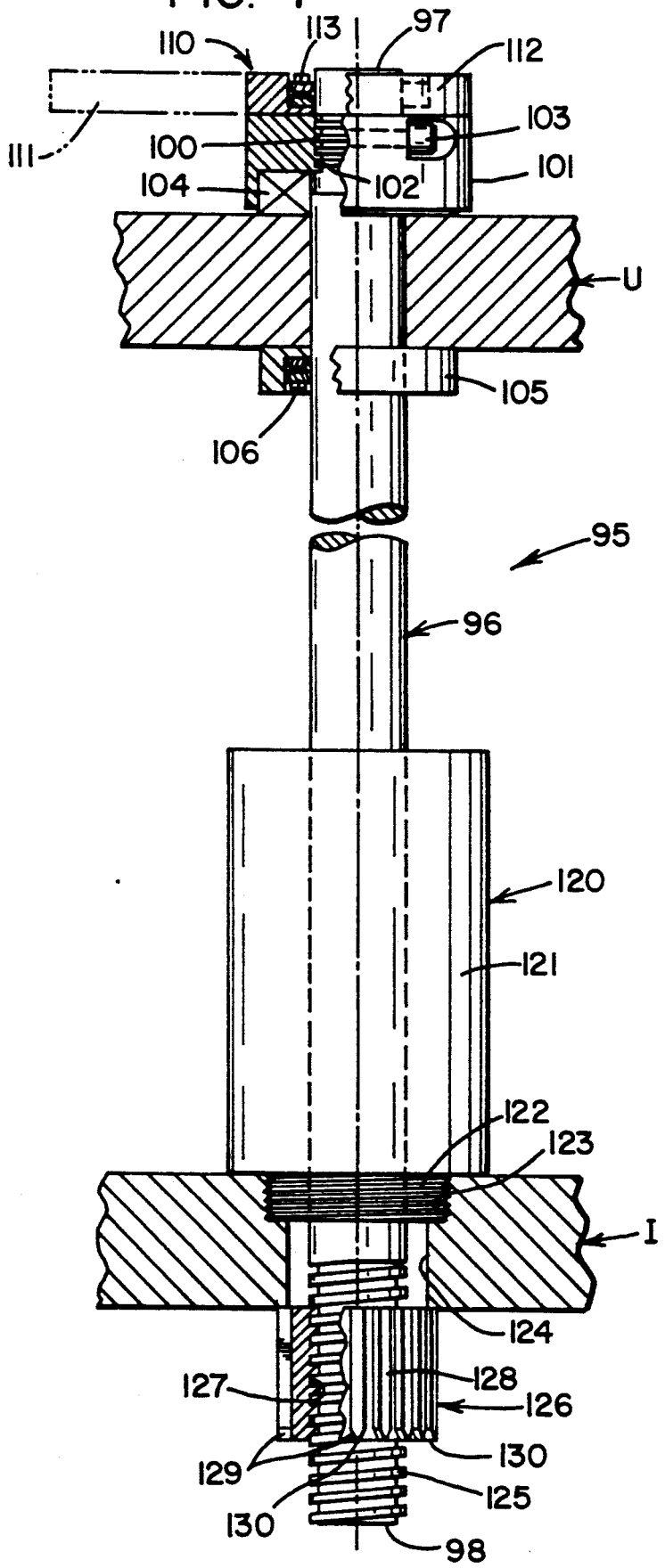
FIG. 7 is a cross-sectional view taken substantially along the line 7—7 of FIG. 1 showing the interrelation of one of the tie rods to the upper moving platen assembly and stationary intermediate platen assembly and a tie rod rotating mechanism for applying clamping force to the molds.
Figure 9:
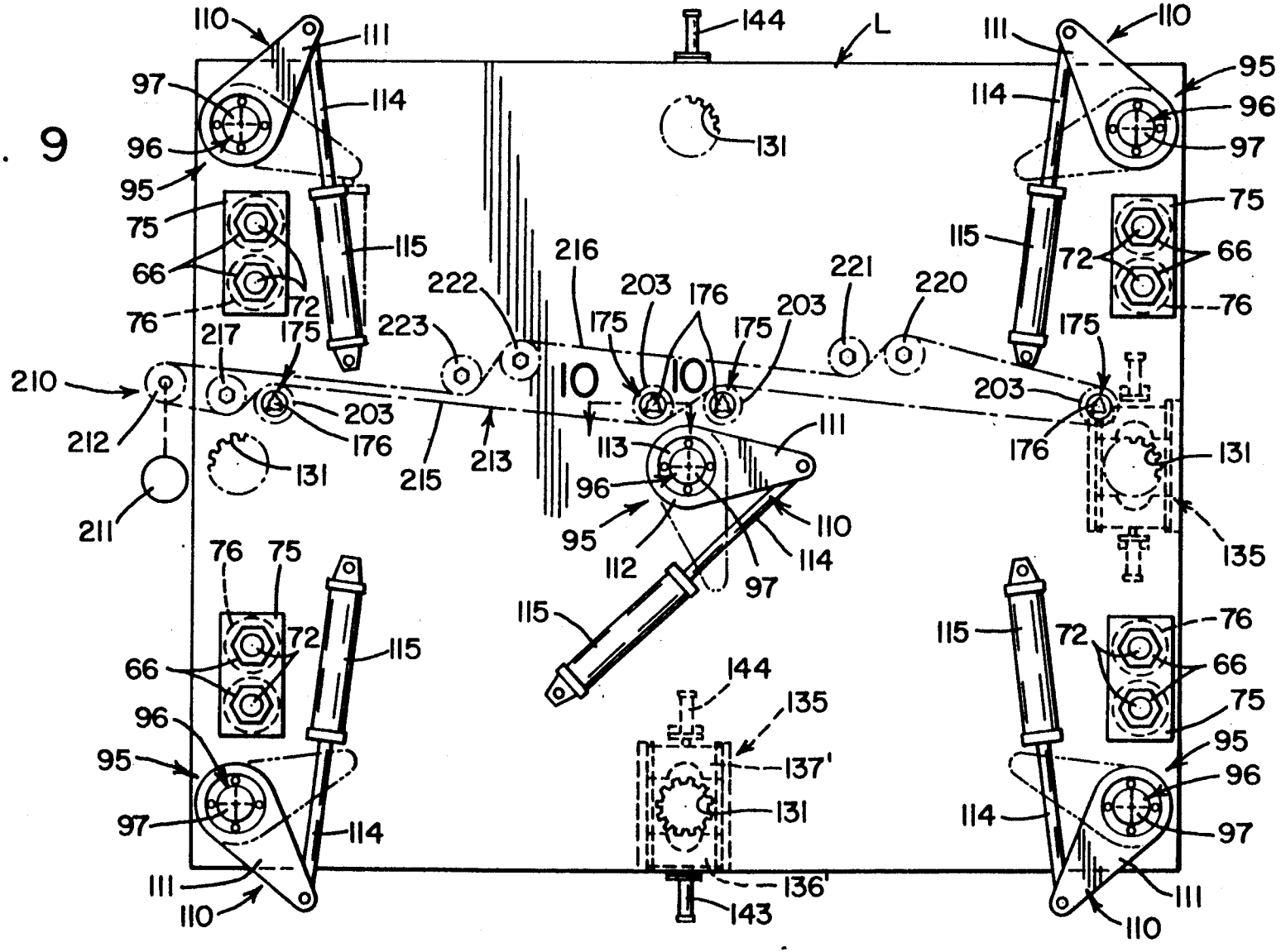
FIG. 9 is a fragmentary bottom plan view of the molding press apparatus, as viewed substantially along the line 9—9 of FIG. 1, showing particularly the drive train for the quill assemblies of the mold loading and unloading apparatus.

Referring particularly to FIGS. 1, 3, and 7, the platen guide and clamping assemblies 95 have as primary guiding and load carrying members elongate tie rods 96. The tie rods 96 each have a fixed end, generally indicated by the numeral 97, and a free end, generally indicated by the numeral 98. As best seen in FIG. 2, the fixed end 97 of four of the tie rods 96 are attached to the upper movable platen assembly U. These are the tie rods 96 associated with the platen guide and clamping assemblies 95 located substantially medially of the front and back and each side of the press 20. As best seen in FIG. 9, the fixed end 97 of the other five tie rods 96 of platen guide and clamping assemblies 95 are located at the lower movable platen assembly L. As best seen in FIG. 2, these are the platen guide and clamping assemblies 95 located at each corner and at the middle of the press 20, as best seen in FIG. 2 of the drawings. The structure of the platen guide and clamping assemblies 95 is identical with the four having the fixed end 97 associated with the upper movable platen assembly U being oriented as depicted in FIG. 7 and with the five having the fixed end 97 associated with the lower movable platen assembly L being inverted. Due to the structural and operational identity of the platen guide and clamping assemblies 95, a only a single such assembly, namely that depicted in FIG. 7 of the drawings, is detailed hereinafter.

Referring now particularly to FIG. 7 of the drawings, the fixed end 97 of tie rod 96 extends through the upper movable platen assembly U and has a plurality of annular rings 100 preferably spaced a distance axially inwardly of the axial extremity of tie rod 96. Tie rod 96 is axially restrained in the position depicted in FIG. 7 by a split collar 101 which has internal grooves 102 that engage the rings 100 of tie rod 96. The split collar 101 has the two sectors thereof detachably secured by a plurality of fasteners such as the cap screws 103. The split collar 101 thus precludes axial movement of the tie rod 96 axially downwardly relative to upper movable platen assembly U when in position as depicted in FIG. 7, with the rings 100 engaged with the grooves 102. The split collar 101 carries a thrust bearing 104 which engages the upper movable platen assembly U to permit high tension forces to be carried by the tie rod 96, yet allow the tie rod 96 to be selectively rotated as described hereinafter. Positioned below the upper movable platen assembly U or to the side opposite the split collar 101, there is a clamping collar 105. The clamping collar 105 has a locking member 106 which may be of the Ringfeder type which precludes movement of the clamping collar 105 relative to tie rod 96 such that the clamping collar 105 thus precludes movement of tie rod 96 upwardly relative to the upper movable platen assembly U from the position depicted in FIG. 7 and thus completes the fixed attachment between the fixed end 97 of tie rod 96 and the upper movable platen assembly U.

The rotation of the tie rod 96 of platen guide and clamping assemblies 95 is effected by rotary actuator assemblies, generally indicated by the numeral 110, as seen in FIGS. 1-4. As shown, each rotary actuator assembly 110 consists of a crank arm 111 which projects radially of a tie rod 96 and, as seen in FIG. 7, may be positioned on tie rod 96 axially adjacent to the split collar 101. The crank arm 111 has a central hub 112 which is bored to receive the extremity of the fixed end 97 of a tie rod 96 and is non-rotatably positioned thereon as by a locking assembly 113 (FIG. 7), which may be of the Ringfeder type. The extremity of crank arm 111 opposite the hub 112 is attached to the cylinder rod 114 having its blind end affixed to the upper movable platen assembly U or the lower movable platen assembly L. It will thus be appreciated that selective actuation of the cylinder 115 will effect arcuate motion of the crank arm 111 and equivalent angular rotation of the tie rod 96 by virtue of the locking assembly 113. It will be appreciated by persons skilled in the art that other devices may be employed to effect selective rotation of the tie rods 96. For example, in lieu of the rotary actuator assemblies 110 shown herein, conventional hydraulic rotary actuating devices, such as those sold under the name Flo-Tork, may be affixed to the tie rods 96 to achieve the selective rotation and torquing requirements of the tie rods 96 as detailed hereinafter.

Each tie rod 96 of each of the platen guide and clamping assemblies 95 is guided during the opening and closing of the press 20 by a guide mechanism, generally indicated by the numeral 120 in FIGS. 1, 3, and 7. As shown, each guide mechanism 120 consists of preferably an elongate bushing 121 which is affixed to the stationary intermediate platen assembly I. As shown, each bushing 121 has a threaded projection 122 which extends into and matingly engages an internally tapped bore 123 in the stationary intermediate platen assembly I, as best seen in FIG. 7. It is to be understood that the bushing 121 of guide mechanism 120 may be otherwise attached to the stationary intermediate platen assembly I. The stationary intermediate platen assembly I has bores 124 concentric with the tapped bore 123 to permit the tie rods 96 to slidably extend through the bushings 121 of the stationary intermediate platen assembly I. It will thus be appreciated that the guide mechanisms 120 associated with each of the platen guide and clamping assemblies 95 insure precise motion and positioning of the tie rods 96 during opening and closing of the press 20 to thus accurately guide the platen assemblies U, L during the requisite vertical displacement.

Figure 8:
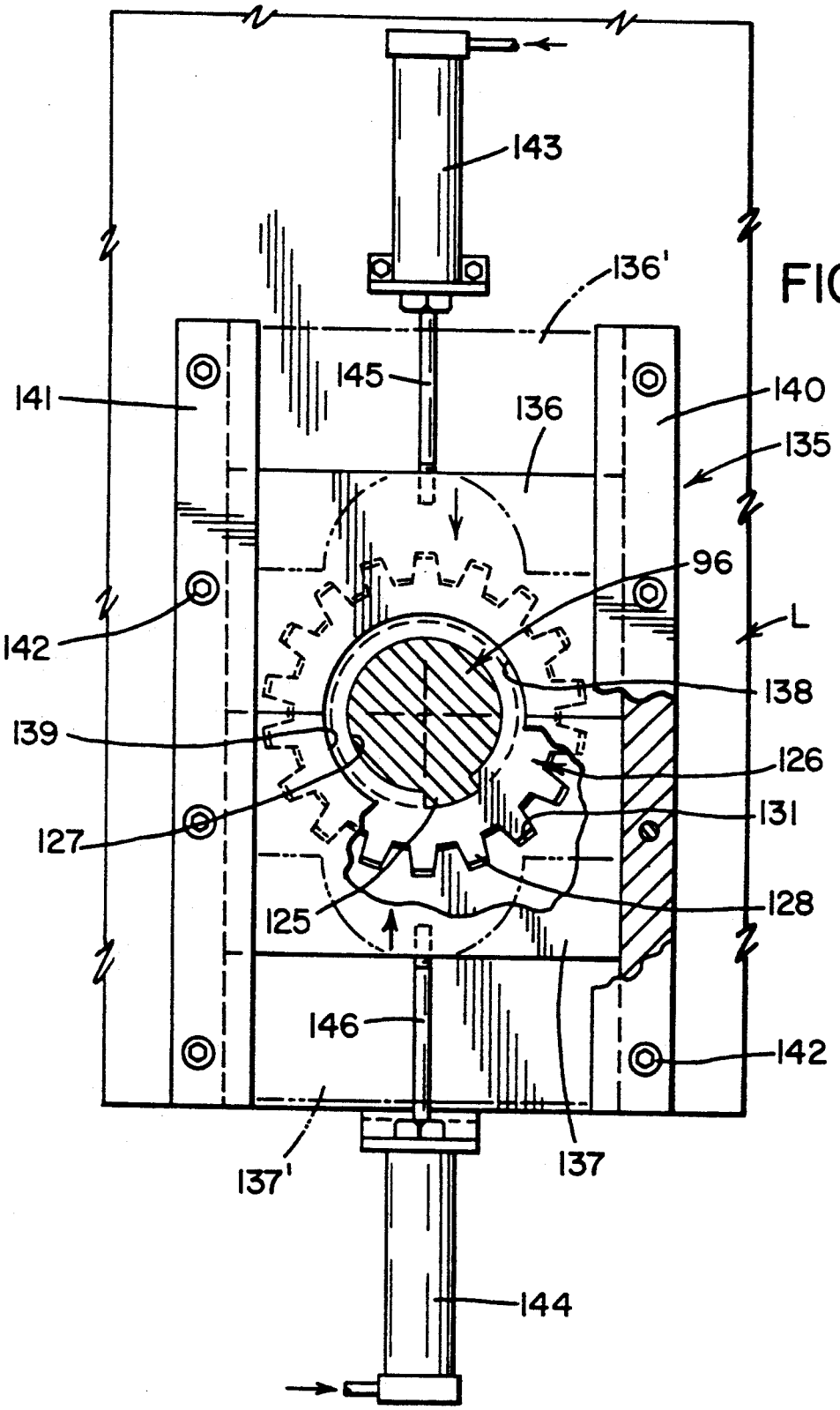
FIG. 8 is a top plan view, as seen substantially along line 8—8 of FIG. 3, showing the retaining mechanism for temporarily securing a guide rod to a moving platen in the closed position of the press.

The free end 98 of tie rod 96 of platen guide and clamping assemblies 95 which extend through the stationary intermediate platen assembly I is provided with suitable threads 125, such as the Acme threads depicted in FIGS. 7 and 8 of the drawings. The free end 98 of tie rods 96 carries a nut 126 which has internal threads 127 that matingly engage the threads 125 on tie rod 96. The nut 126 has external splines 128 extending axially thereof. The splines 128 have a taper 129 proximate the axial extremity thereof which terminate in pointed ends 130 at the extremity of each of the splines 128.

When the press 20 moves from the open position, with the splined nut 126 proximate the stationary intermediate platen assembly I, to the closed position depicted in FIG. 3 of the drawings, the tie rods 96 move downwardly until the nut 126 penetrates matingly splined holes 131 in the lower movable platen assembly L (see FIG. 8 and lower middle portion of FIG. 3). The splined holes 131 may have the splines upwardly tapered in a manner similar to the splines 128 to permit insertion of nuts 126 into splined holes 131, irrespective of the rotational position of the nut 126 on tie rods 96.

The upper movable platen assembly U and the lower movable platen assembly L are interlocked when the press 20 is closed, with the nut 126 attached to tie rod 96 in the splined hole 131 in lower movable platen assembly L, by nut locking mechanisms 135 seen particularly in FIGS. 3 and 8. As seen in FIG. 3, the nut locking mechanisms 135 for the platen guide and clamping assemblies 95 having the fixed end 97 attached to the upper movable platen assembly U are positioned atop the lower movable platen assembly L. As shown, the nut locking mechanism 135 consists of a pair of retaining plates 136 and 137 which may be generally rectangular. The retaining plates 136, 137 have opposed semicircular cut-outs 138 and 139, which are preferably of a slightly greater diameter than the tie rods 96 which extend therethrough but which are configured such that a substantial portion of the plates 136, 137 overlie the nut 126, with the plates 136, 137 in the locking position depicted in solid lines in FIG. 8 of the drawings. The retaining plates 136, 137 are slidably mounted on the lower movable platen assembly L by means of a pair of spaced, substantially parallel rails 140 and 141. The rails 140, 141 may be of L-shaped cross-sectional configuration, as seen in the lower central portion of FIGS. 1 and 3, and are rigidly affixed to the lower movable platen assembly L as by a plurality of fasteners 142.

The rails 140, 141 are disposed such that they retain and guide the retaining plates 136, 137 for motion substantially radially of the tie rod 96 from the locked position of the retaining plates 136, 137, depicted in solid lines in FIG. 8 of the drawings, to the chain line position 136', 137', also depicted in FIG. 8, which is the unlocked position of nut locking mechanism 135. It is apparent that with the retaining plates 136, 137 in the unlocked chain line position 136', 137', the nut 126 may be readily inserted into the splined hole 131 during closure of press 20, retained therein when the retaining plates 136, 137 are moved to the locked position, and removed therefrom when the retaining plates 136, 137 are again moved to the unlocked position to effect opening of the press 20 subsequent to the molding operation. Movement of the retaining plates 136, 137 between the locked and unlocked positions may be effected as by cylinders 143 and 144 attached to the lower movable platen assembly L and having their cylinder rods 145 and 146 attached to retaining plates 136 and 137, respectively.

It will be appreciated that once the press 20 is closed so that the nut 126 reposes in the splined hole 131, the cylinders 143, 144 may be actuated to move the retaining plates 136, 137 from the unlocked to the locked position. The nut 126 is thus rotationally restricted by virtue of the interengagement between the splines 128 on the nut 126 and the splined hole 131 and axially restrained to prevent separation of the upper movable platen assembly U and the lower movable platen assembly L by virtue of the nut locking mechanism 135. Actuation of the rotary actuator assemblies 110 at this time effects a threading of the tie rod 96 into the nut 126, with sufficient torque being applied to effect the requisite clamping tonnage for the molding process involved.

It is to be appreciated that all nine of the platen guide and clamping assemblies 95 may have the rotary actuator assemblies 110 thereof simultaneously actuated to effect the clamping action between the upper movable platen assembly U and the lower movable platen assembly L to supply the necessary clamping forces to the molds M positioned in the mold mounting spaces S1, S2, S3, and S4. It is also to be noted that the effective length of the tie rods 96 may be adjusted for component wear, differences in the thickness of mold sections M1, M2, and other conditions by rotating the nut 126 while the press 20 is in the open position depicted in FIG. 7 or by restricting rotation of the nut 126 while selectively actuating the rotary actuator assembly 110. The platen guide and clamping assemblies 95 thus provide ease of operation and adjustment under a variety of operating conditions and employing a variety of molds M.

A preferred arrangement of the press 20 for carrying out the present invention has been shown and described above. It will, however, be appreciated that the stationary intermediate platen assembly I could be eliminated while retaining the advantages of the counterbalanced upper and lower movable platen assemblies U, L mounting mold parts for one or more molds. In such instance, the tie rods of the platen guide and clamping assemblies could be controlled by guide mechanisms mounted on or supported by members affixed to the framework 25. As another alternative, nine cylinders could be employed in lieu of the platen drive assembly 80 and the platen guide and clamping assemblies 95 to effect opening and closing of the press 20 and the application of clamping tonnage while retaining the advantages of the counterbalanced upper and lower movable platen assemblies U, L.

Figure 4:
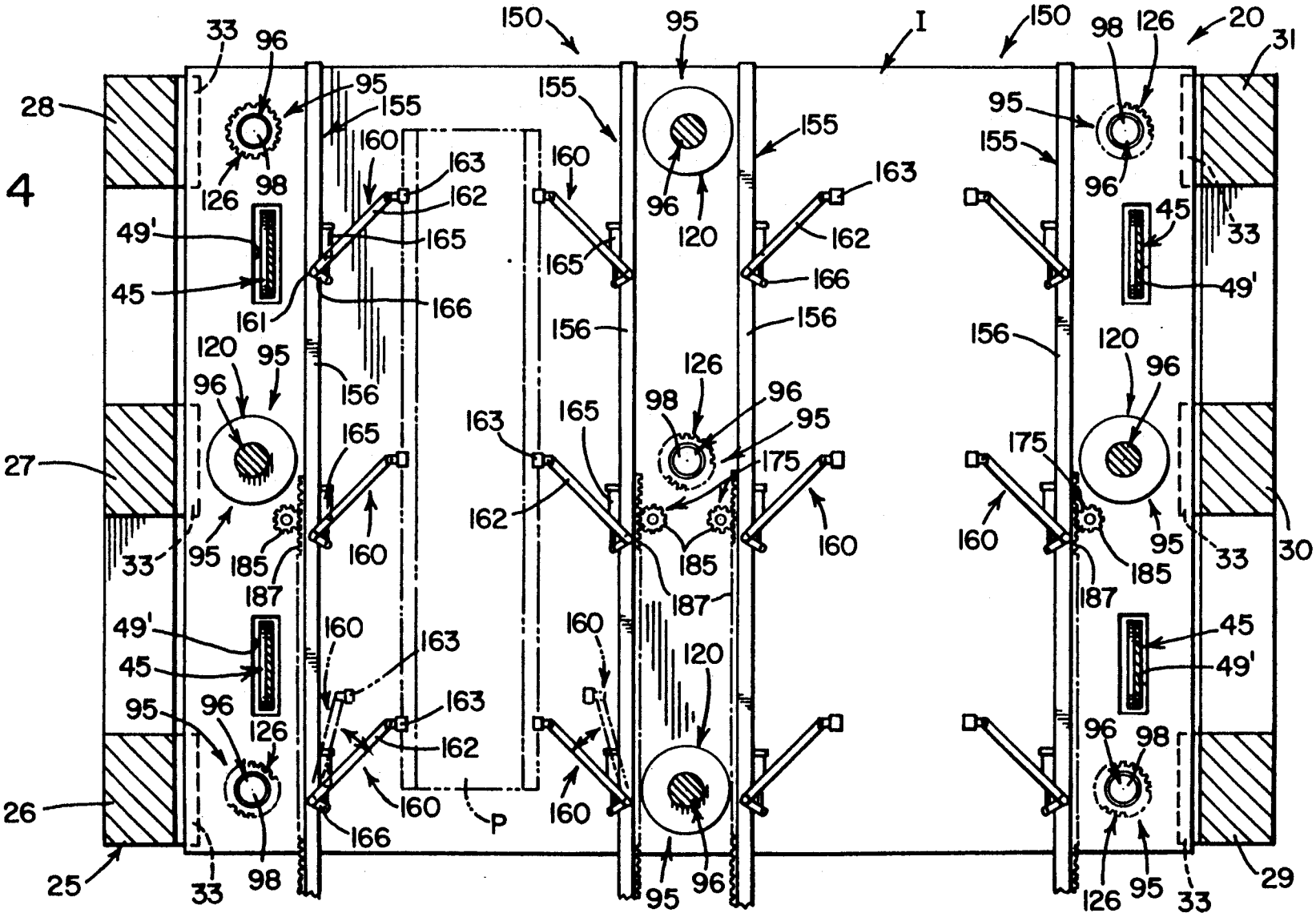
FIG. 4 is a sectional view taken substantially along the line 4–4 of FIG. 1 showing details of the center platen and associated components and a portion of the shuttle mechanism for delivering preformed fiber reinforcements to the mold cavities and for removing completed molded parts therefrom.

The potential for realizing the substantial increases in productivity which are afforded by press 20, which is capable of molding four fiber reinforced parts simultaneously, may be greatly enhanced by robotic loading and unloading apparatus, generally indicated by the numeral 150 in FIGS. 1, 3, and 4. FIG. 3 of the drawings depicts a molded part P being molded between the upper female mold section M1 and the lower male mold section M2 in mold mounting space S1 in the press 20. A loading and unloading apparatus 150 is positioned proximate to each of the molds M in the mold mounting spaces S1, S2, S3, and S4. Each loading and unloading apparatus 150 consists of a pair of spaced shuttle assemblies, generally indicated by the numeral 155. As seen in FIGS. 1, 3, 4, and 11, a shuttle assembly 155 extends from front to back of the press 20 proximate the lateral extremities of each of the mold mounting spaces S1, S2, S3, and S4.

Figure 10:
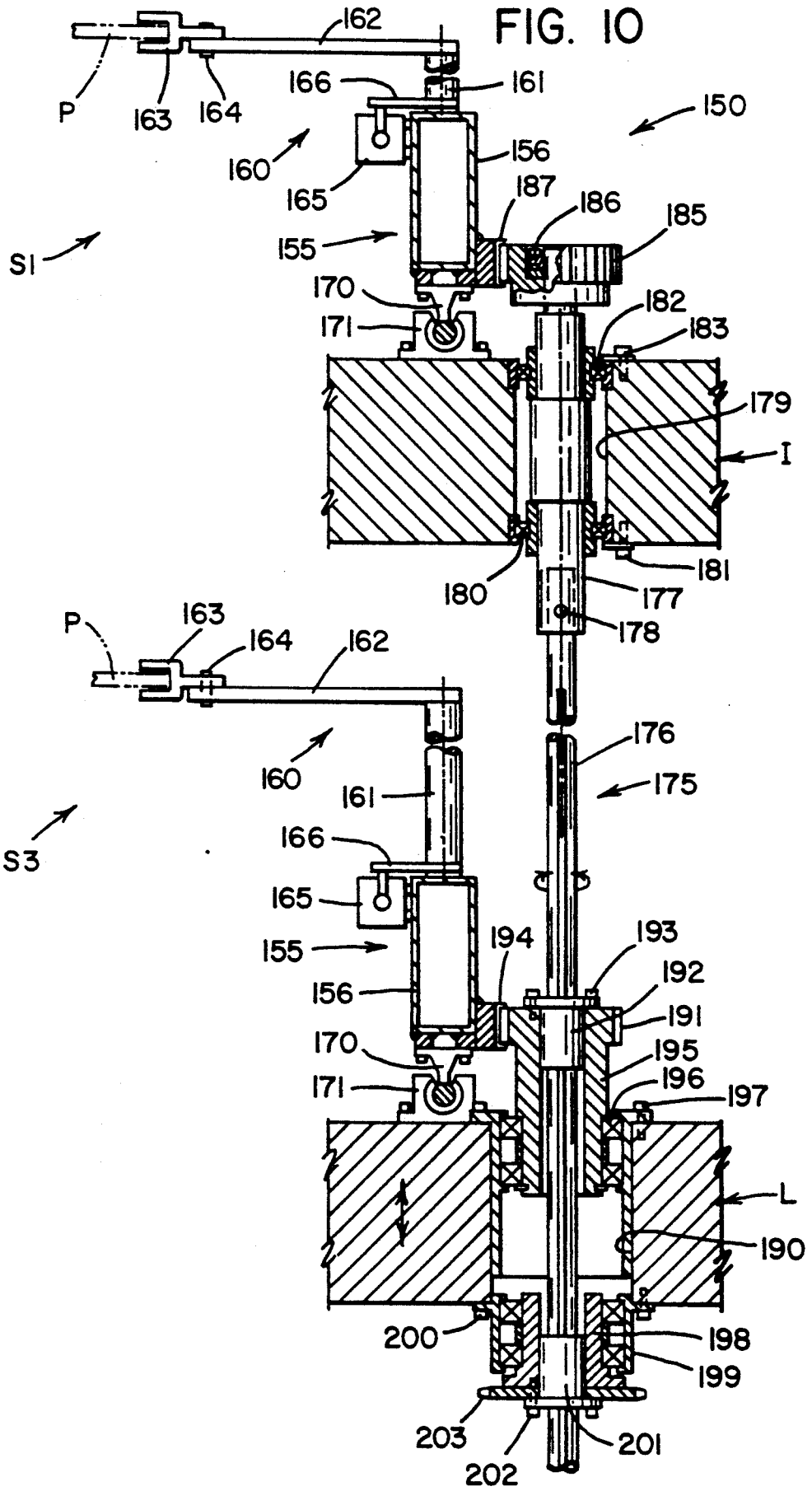
FIG. 10 is a cross-sectional view taken substantially along the line 10—10 of FIG. 9 showing details of a quill assembly and the interrelation with two vertically displaced shuttle mechanisms of the mold loading and unloading apparatus.
Figure 11:
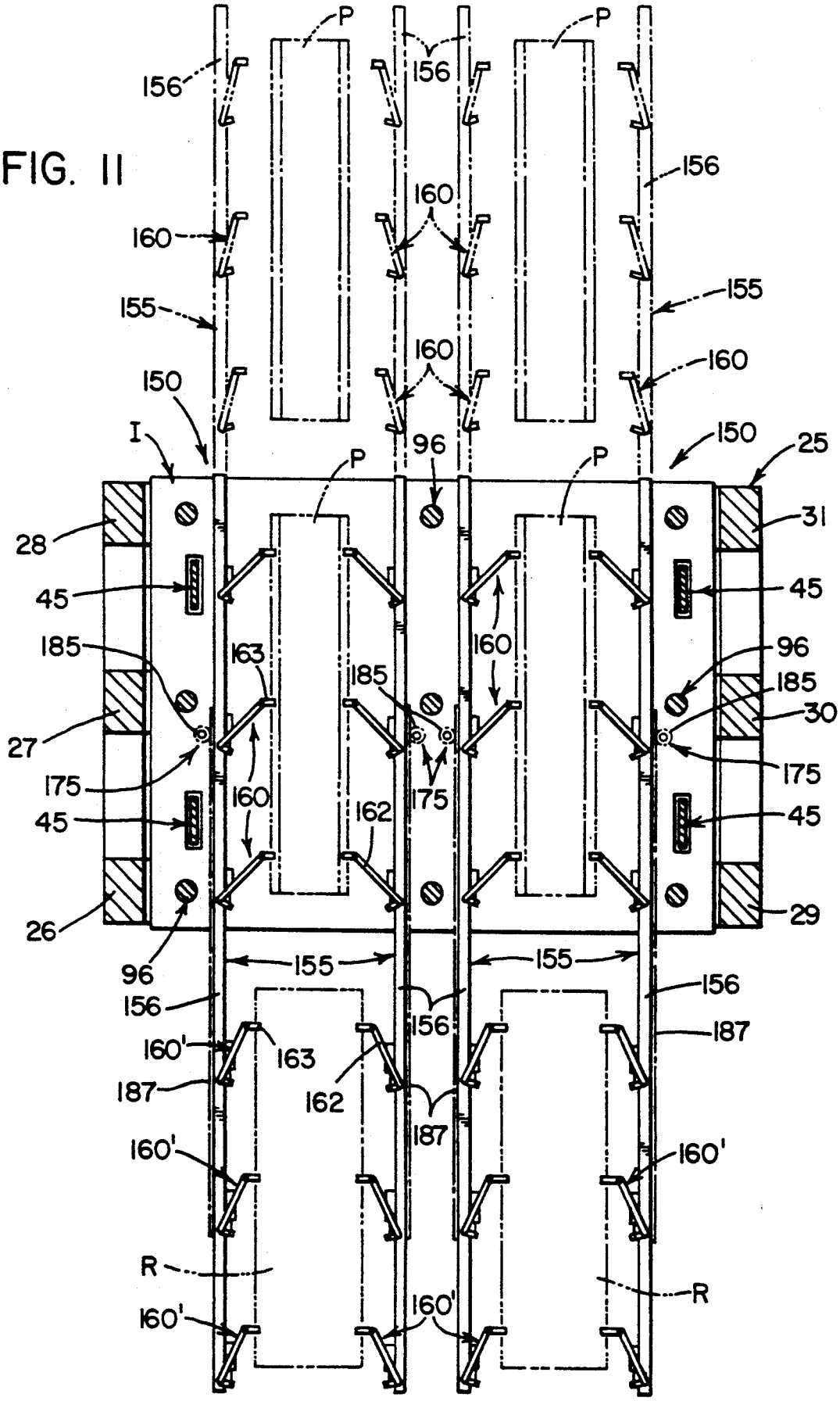
FIG. 11 is a reduced-size sectional view similar to FIG. 4 showing the shuttle mechanism in the position for picking up preformed fiber reinforcements and for engaging completed molded parts in solid lines and in the position for depositing preformed fiber reinforcements in the molds and for discharging completed molded parts in chain lines.

Referring now particularly to FIGS. 4, 10, and 11, each of the shuttle assemblies 155 consists of an elongate linear frame 156 which may be rectangular and which is of substantially greater length than the molded parts P. Each of the frames 156 carries a plurality of part-engaging members, generally indicated by the numerals 160 and 160'. While three part-engaging members 160 for molded parts P and three longitudinally displaced part-engaging members 160' for preformed fiber reinforcements R are shown by way of example mounted at spaced locations along the shuttle assemblies 155 (see FIG. 11), it is to be appreciated that the number of such part-engaging members 160, 160' may be varied, depending upon the longitudinal extent of the molded parts P being molded in a particular operation.

As somewhat schematically depicted in FIGS. 1, 3, 4, 10, and 11 of the drawings, the part-engaging members 160, 160' each include an upstanding post 161 which is pivotally mounted on frame 156. Each post 161 mounts a laterally extending arm 162. The extremity of each arm 162 displaced from the upstanding posts 161 are provided with gripping fingers 163 which may be attached by a pivot pin 164 for selective rotational positioning of the gripping fingers 163 relative to the arms 162. It is to be appreciated that more elaborate gripping elements may be employed if necessary in lieu of the bifurcated gripping fingers 163 which are shown engaging a molded part P in FIGS. 1, 4, 10, and 11 of the drawings. Also, the gripping fingers 163 of part-engaging members 160 and 160' may differ to better accommodate the molded parts P and performed fiber reinforcements R.

The pivotal mounting of the upstanding post 161 permits the selective angular displacement of the part-engaging members 160, 160' from a part-engaging position depicted in solid lines in FIGS. 4 and 11 of the drawings where the fingers 163 engage molded parts P to a retracted position depicted in chain lines at the left-hand side of FIG. 4 of the drawings. As shown, control of the pivotal motion of the part-engaging members 160 between the part-engaging and the retracted positions may be effected by hydraulic or pneumatic cylinders 165 operating through connecting links 166 rigidly attached to upstanding posts 161 for effecting suitable angular rotation thereof.

The removal of molded parts P from the press 20 and the delivery of preformed fiber reinforcements R to the mold cavities is effected by simultaneously moving the shuttle assemblies 155 of the loading and unloading apparatus 150 servicing each of the mold mounting spaces S1, S2, S3, and S4. The movement of the shuttle assemblies 155 bidirectionally front to back of the press 20, as best appreciated in FIG. 4 of the drawings, is facilitated by a linear bearing assembly 170 mounted on the underside of each of the frames 156 of shuttle assemblies 155. Linear bearing receptors 171 may be conveniently mounted atop the stationary intermediate platen assembly I and the lower movable platen assembly L for servicing the mold mounting spaces S1, S2, S3, and S4.

A drive quill, generally indicated by the numeral 175, may be positioned to drive shuttle assemblies 155 which are vertically displaced on the stationary intermediate platen I and the lower movable platen L, as seen in FIG. 10. Thus, a total of four drive quills 175, positioned as depicted particularly in FIGS. 4, 10, and 11, are sufficient to power all of the shuttle assemblies 155 of the loading and unloading apparatus 150 for each of the mold mounting spaces S1, S2, S3, and S4. Each drive quill 175 contains as a primary power transmitting member an elongate spline shaft 176 which extends from a position proximate the stationary intermediate platen assembly I to a position below the lower movable platen assembly L when the press 20 is in both the open and closed positions (see FIGS. 1 and 3, respectively). Referring now to FIG. 10 of the drawings, each of the spline shafts 176 mount at the upper extremity thereof, as seen in FIG. 10, an enlarged sleeve 177. The sleeve 177 is affixed to spline shaft 176 as by a pin 178 to preclude relative rotation therebetween. The sleeve 177 passes through a bore 179 in the stationary intermediate platen assembly I. The sleeve 177 is freely rotatably supported relative to the stationary intermediate platen assembly I as by a lower bearing race 180 affixed as by a fastener 181 to the underside of the stationary intermediate platen assembly I and by an upper bearing race 182 affixed as by a fastener 183 to the upper surface of the stationary intermediate platen assembly I. The sleeve 177 is thus freely rotatable relative to stationary intermediate platen assembly I, but as will be seen hereinafter, is axially fixed relative therto.

Each drive quill 175 has at the axially upper extremity of the sleeve 177 a pinion 185, which is attached thereto as by a suitable locking assembly 186. The pinion 185 engages an elongate rack 187 which is rigidly affixed to and extends a suitable length of the frame 156 of each shuttle assembly 155 (see FIGS. 4 and 10). It will thus be understood that rotation of the spline shaft 176 effects equivalent angular rotation of the sleeve 177 and pinion 185 in either direction to produce commensurate linear displacement of shuttle assemblies 155 positioned in the mold mounting spaces S1 and S2.

As best seen in FIG. 10, the spline shaft 176 of drive quills 175 also extend through bores 190 in the lower movable platen assembly L. Positioned proximate to but preferably slightly above the lower movable platen assembly L is a pinion 191 which is attached to a spline nut 192 as by fasteners 193. Thus, the pinion 191 and spline nut 192 are free to traverse along while rotating with spline shaft 176 as the lower movable platen assembly L moves vertically during opening and closing of the press 20. In a manner similar to pinion 185, the pinion 191 matingly engages a rack 194 rigidly attached to and extending the length of the frame 156 of the shuttle assemblies 155 positioned in each of the mold mounting spaces S3 and S4. As shown, the pinion 191 has an axially elongate hub 195 which extends into and is freely rotatably supported within the bore 190 of the lower movable platen assembly L as by a bearing race 196 affixed to the upper side of the lower movable platen assembly L as by fasteners 197.

Positioned on the spline shaft 176 of drive quills 175 on the underside of the lower movable platen assembly L is a flanged sleeve 198 which is freely rotatably mounted and aligned relative to the lower movable platen assembly L by a bearing carrier 199 affixed to the lower movable platen assembly L as by fasteners 200. The sleeve 198 carries a spline nut 201 which is attached thereto as by a plurality of fasteners 202. Interposed between the axial extremity of the spline nut 201 and the sleeve 198 is a sprocket 203. The sprocket 203 is attached to both the sleeve 198 and the spline nut 201, as by the fasteners 202, such that rotation of the sprocket 203 produces concurrent rotation of the spline nut 201, the sleeve 198, and the spline shaft 176 of a drive quill 175.

From the above description, it will be understood that each of the drive quills 175 drive a shuttle assembly 155 associated with the lower movable platen assembly L and a shuttle assembly 155 associated with the stationary intermediate platen assembly I. In particular, the raising and lowering of the lower movable platen assembly L is accommodated by the spline nuts 192 and 201, which are slidable on the spline shaft 176. However, the spline nuts 192 and 201 transmit rotation of the sprocket 203 through the pinion 191 to the rack 194 of shuttle assemblies 155.

Each of the four drive quills 175 may be independently powered to effect the necessary direction and extent of rotation of the sprockets 203 to actuate the loading and unloading apparatus 150. However, since the loading and unloading apparatus 150 may all be actuated at the same time to effect the removal of molded parts P and the delivery of preformed fiber reinforcements R to the mold mounting spaces S1, S2, S3, and S4, a common drive quill drive assembly, generally indicated by the numeral 210 in FIG. 9 of the drawings, may advantageously be employed to concurrently drive all of the four drive quills 175.

Such a drive quill drive assembly 210 is somewhat schematically shown in FIG. 9 of the drawings as mounted on the underside of the lower movable platen assembly L. The exemplary drive quill drive assembly 210 is powered by a suitable motor 211 which may be coupled with a reducer and suitable controls of a type known to persons skilled in the art for selecting the direction and extent of rotation necessary to effect the operations of robotic loading and unloading apparatus 150. The motor 211 is interconnected as by a chain drive or suitable gearing (not shown) to a drive sprocket 212. The drive sprocket 212 powers a chain 213, which is the interconnecting motive member for the four sprockets 203. The closed path of the drive chain 213, which extends laterally of the press 20 as seen in FIG. 9, consists of a lower drive run 215 and an upper return run 216. The drive run 215 consists of an extent of chain 213 which engages the four sprockets 203 of the drive quills 175 from left to right laterally of the press 20, as seen in FIG. 9 of the drawings. The drive run 215 also includes an idler sprocket 217 to effect proper wrap around the sprockets 203 and control of the drive run 215 to achieve proper rotation of the four sprockets 203 such that the shuttle assemblies 155 of each loading and unloading apparatus travel together in the same direction. The return run 216 of chain 213 extends from right to left across the press 20, as viewed in FIG. 9, and consists of a first pair of idler sprockets 220, 221 which offset the chain 213 from the drive run 215 and a second pair of idler rolls 222 and 223 which redirect the chain 213 for engaging the drive sprocket 212. Other arrangements for the drive quill drive assembly 210 may, of course, be employed to interconnect and simultaneously power the four drive quills 175 at identical speeds and proper directions of rotation.

In operation, the press 20 is shown in FIG. 1 in the press open position at the conclusion of a molding operation producing four molded parts P. As shown, the loading and unloading apparatus 150 have been moved by the drive quill drive assembly 210 having motor 211 actuated to rotate drive quills 175 to locate the shuttle assemblies 155, as depicted in FIGS. 1 and 4 and in solid lines in FIG. 11 of the drawings, in position where the cylinders 165 have been actuated to pivot arms 162 so that gripping fingers 163 of part-engaging members 160 are in engagement with the molded parts P. The molded parts P may be manipulated by extending the arms 162, as by conventional stripping apparatus or otherwise, to clear the lower mold sections M2 such that they are totally supported by the part-engaging members 160 of shuttle assemblies 155. Either simultaneously or previously, the part-engaging members 160' are actuated to engage preformed fiber reinforcements R made available as by conveyors (not shown).

The motor 211 of drive quill drive assembly 210 is then activated to move the shuttle assemblies 155 carrying the molded parts P to the rear of the press 20, as depicted in chain lines in FIG. 11, for discharge onto a conveyor for transport to other processing or storage. Actuation of the hydraulic cylinders 165 to pivot arms 162 effects release of the molded parts P by the gripping fingers 163 of part-engaging members 160 to complete discharge of the parts P from the press 20. The movement of shuttle assemblies 155 simultaneously transports preformed fiber reinforcements R from a position proximate the front of the press 20 (FIG. 11) to mold mounting spaces S1, S2, S3, and S4 for the next molding operation. In this respect, the preformed fiber reinforcements R are picked up by the assemblies 155 where the molded parts P are discharged or at the other side of the press 20 to provide additional space for conveyors or other handling equipment. The gripping fingers 163 of part-engaging members 160' of the shuttle assemblies 155 release the preformed fiber reinforcements R by actuation of the cylinders 165, which serves to return the part-engaging members 160' to the retracted position seen in FIG. 4 of the drawings. Once the preformed fiber reinforcements R employed in a molding operation are in place on the lower molds M1, the press 20 is ready for commencement of the next molding cycle.

The closing of the press 20 is instituted by activating the motor 81 of the platen drive assembly 80 to simultaneously rotate the sprockets 38, 39 of platen suspension assemblies 35, 36 to displace the lift chains 45 and thus simultaneously move the upper movable platen assembly U downwardly and the lower movable platen assembly L upwardly from the press open position depicted in FIG. 1 of the drawings to the press closed position depicted in FIG. 3 of the drawings. During opening and closing of the press 20, the lateral alignment of the upper and lower platen assemblies U, L relative to the intermediate platen assembly I is maintained by the tie rods 96 of the platen guide and clamping assemblies 95 slidably engaging the bushings 121 affixed to the stationary intermediate platen assembly I. The molds M are preloaded after the aforedescribed closure. This is accomplished by continued operation of the motor 81 of platen drive assembly 80, which compresses the disk springs 76 of the platen attachment assemblies 70 to overcome gravity effects operative on the lower movable platen assembly L and thus progresively forcibly seat and preload the molds M between the lower movable platen assembly L and the intermediate platen assembly I. Concomitantly, the compression of disk springs 76 creates an extent of slack in the lift chains 45 such that gravity forces operative on the upper movable platen assembly U effect seating and preloading of the molds M positioned between the upper movable platen assembly U and the stationary intermediate platen assembly I.

With the closure of the press 20 and preloading of the molds M, the nuts 126 on the rods 96 are axially restrained by actuating cylinders 143, 144 to move retaining plates 136, 137 of the nut locking mechanism 135 to the locked position. Thereafter, powering of the rotary actuator assemblies 110 to rotate tie rods 96 with nuts 126 rotationally restrained in the splined holes 131 effects threading of the tie rods 96 into the nuts 126, with sufficient torque being applied to produce the requisite clamping tonnage for the molding process involved.

At this time, the reactive liquid resin is injected into the molds M according to conventional practice well known in the art. Due to the close proximity of the four molds M as arranged in the press 20, a single pumping and metering system may readily be employed for sequentially servicing all of the molds. Thereafter, a suitable time interval is provided for cure of the resin injected into the molds M.

Preparation for opening of the press 20 to remove the completed molded parts P is commenced by actuation of the rotary actuator assemblies 110 to unthread the tie rods 96 from the nuts 126 a distance sufficient to relieve clamping pressure from the molds M. The actuating cylinders 143, 144 are then powered to move retaining plates 136, 137 to the unlocked position to free the nut 126 and tie rods 96 for axial movement.

The opening of the press 20 is instituted by activating the motor 81 of the platen drive assembly 80 for shaft rotation in the direction opposite that employed for closing the press 20. Motor 81 simultaneously rotates sprockets 38, 39 of the platen suspension assemblies 35, 36 to displace the lift chains 45 and thus simultaneously move the upper movable platen assembly U upwardly and the lower movable platen assembly L downwardly from the press closed position of FIG. 3 to the press open position of FIG. 1. The four completed molded parts P are then stripped from the molds M according to conventional practice, and the unloading of the molded parts P and the simultaneous loading of preformed fiber reinforcements R proceed as described above to institute another molding cycle of the press 20.

Thus, it should be evident that the molding press for producing fiber reinforced parts of reactive liquid resins disclosed herein carries out various of the objects of the invention as set forth above and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

We claim:

1. Molding press apparatus for simultaneously operating a plurality of molds having multiple mold parts comprising, framework means, first and second platen means supported by said framework means for carrying mold parts of the molds, third platen means interposed between said first and second platen means for mounting mating mold parts in opposed relation to the mold parts carried by said first and second platen means, means for counterbalancing said first platen means in relation to said second platen means, drive means for simultaneously moving said first and second platen means relative to said third platen means for opening and closing the molds and platen guiding and clamping means carried by said first and second platen means for guiding said first and second platen means during movement relative to said third platen means, for interlocking said first and second platens when the molds are closed and for applying clamping forces to the molds during the molding operation.

2. A press according to claim 1, wherein said third platen means is affixed to said framework means.

3. A press according to claim 1, wherein said framework means includes a plurality of vertical posts interconnected by a top plate, said third platen means being attached to said vertical posts.

4. A press according to claim 1, wherein said means for counterbalancing said first platen means in relation to said second platen means includes chain means attached to said first platen means and said second platen means, said chain means being reeved about sprocket means.

5. A press according to claim 4, wherein a plurality of spaced sprocket means carry a plurality of chain means attached to said first platen means and said second platen means.

6. A press according to claim 4, wherein shaft means mount said sprocket means and said drive means includes drive sprocket means attached to said shaft means and drive chain means interconnecting said drive sprocket means with drive motor means, whereby selective directional actuation of said drive motor means effects substantially equidistant vertical movement of said first platen means and second platen means for simultaneously opening and closing the plurality of molds.

7. A press according to claim 4, wherein platen attachment assemblies interconnect said chain means and said first and second platen means.

8. A press according to claim 7, wherein said first platen means is positioned above said third platen means and said second platen means is positioned below said third platen means and said platen attachment assemblies interconnecting said chain means and said second platen means include compression spring means for progressively forcibly seating and preloading the molds between said second and third platen means upon continued actuation of said drive means when the molds are closed, whereby the resulting compression of said spring means produces slack in said chain means such that the molds between said first and third platen means are preloaded by gravity.

9. Molding press apparatus for simultaneously operating a plurality of molds having multiple mold parts comprising, framework means, first and second platen means supported by said framework means for carrying mold parts of the molds, third platen means interposed between said first and second platen means for mounting mating mold parts in opposed relation to the mold parts carried by said first and second platen means, means for counterbalancing said first platen means in relation to said second platen means, drive means for simultaneously moving said first and second platen means relative to said third platen means for opening and closing the molds and platen guiding and clamping means carried by said first and second platen means for guiding the movement of said first and second platen means relative to said third platen means during opening and closing of the molds and for clamping the molds during the molding operation.

10. A press according to claim 9, wherein said guiding and clamping means includes tie rod means for guiding said first and second platen means during opening and closing of the molds and for serving as load carrying members during clamping of the molds.

11. A press according to claim 10, wherein some of said tie rod means have a fixed end attached to said first platen means, other of said tire rod means have a fixed end attached to said second platen means, and guide bushing means attached to said third platen means for slidably engaging said tie rod means and guiding said first and second platen means during the movement thereof.

12. A press according to claim 11, wherein said fixed ends of said tie rod means are attached to either of said first and second platen means by split collars having internal grooves engaging annular rings in said tie rod means proximate the extremity thereof to one side of said either of said first and second platen means and a clamping collar to the other side of said either of said first and second platen means.

13. A press according to claim 11, wherein said tie rod means attached to either of said first and second platen means have a free end rotatably mounting an externally axially splined nut for engaging a splined hole in the other of the first and second platen means to preclude rotation of said splined nut when the molds are in the closed position.

14. A press according to claim 13, including a nut locking mechanism having retaining plates selectively movable to overlie a substantial portion of said splined nut when positioned in said splined hole to thereby axially restrain separation of said first platen means and said second platen means.

15. A press according to claim 14, including actuator means for selectively rotating said tie rod means when said splined nut is restrained by said retaining plates to effect the requisite clamping tonnage to the molds for the molding process.

16. Molding press apparatus for operating a plurality of mold parts of a mold comprising, framework means, first and second platen means supported by said framework means for carrying the mold parts of the mold in opposed relation, means for counterbalancing said first platen means in relation to said second platen means, drive means for simultaneously moving said first and second platen means relative to each other for opening and closing the mold and platen interlocking and clamping means having tie rod means affixed to one of said first and second platen means and interlockable with the other of said first and second platen means by actuating locking means associated therewith when the mold is closed and having means for rotating said tie rod means for threading into nut means for applying clamping loading to the mold parts during the molding process.

17. A press according to claim 16, wherein said means for counterbalancing said first platen means in relation to said second platen means includes suspension means supported by said framework means for carrying a plurality of connector means, each of said connector means having chain means attached to said first platen means and said second platen means.

18. A press according to claim 17, wherein said suspension means include sprockets for engaging said chain means, said drive means selectively rotating said sprockets in one direction to close the mold parts and in the other direction to open the mold parts.

19. A press according to claim 16, wherein each of said first and second platen means carry mating mold parts of a plurality of molds, whereby said drive means provides for simultaneous opening and closing of said plurality of molds.

* * * * *